United States Patent [19]

Schooler, Sr. et al.

[11] 3,965,655

[45] June 29, 1976

[54] FOOD PRODUCT PACKAGING APPARATUS

[76] Inventors: William H. Schooler, Sr., 1913 Jackson St., Burbank, Calif. 91504; William H. Schooler, Jr., 1013 N. Howard St., Glendale, Calif. 91207

[22] Filed: Dec. 30, 1976

[21] Appl. No.: 537,246

[52] U.S. Cl. ..... 53/225

[51] Int. Cl.[2] ..... B65B 11/28

[58] Field of Search ..... 53/221, 222, 223, 224, 53/225, 226, 227, 212, 234

[56] References Cited

UNITED STATES PATENTS

| | | | |
|---|---|---|---|
| 789,531 | 5/1905 | Forbes | 53/221 |
| 974,453 | 11/1910 | Wilbur | 53/225 X |
| 1,131,881 | 3/1915 | Wilbur | 53/227 X |
| 2,060,986 | 11/1936 | Gaubert | 53/221 |
| 2,090,257 | 8/1937 | Hunter | 53/227 |
| 2,830,417 | 4/1958 | Ullman | 53/226 |
| 3,056,246 | 10/1962 | Lyon | 53/225 X |
| 3,323,273 | 6/1967 | Lee | 53/221 X |
| 3,775,940 | 12/1973 | Hatanaka | 53/212 |

FOREIGN PATENTS OR APPLICATIONS

| | | | |
|---|---|---|---|
| 644,126 | 10/1950 | United Kingdom | 53/226 |

*Primary Examiner*—Travis S. McGehee
*Assistant Examiner*—John Sipos
*Attorney, Agent, or Firm*—Roger A. Marrs

[57] ABSTRACT

An apparatus is disclosed herein having a pocketed turntable for carrying multiple stacks of a food product to a wrapping station and which includes mechanism for selectively engaging each stack and directing the stack onto a wrapping paper sheet. A cutting device severs the sheet and a wrapping device folds the paper about the stack. A heating element secures and seals the paper so as to complete the package. Programming mechanism is included for selectively sequencing the operation of the turntable, arm, wrapping paper feed, cutting device and heating element.

7 Claims, 12 Drawing Figures

Fig. 6
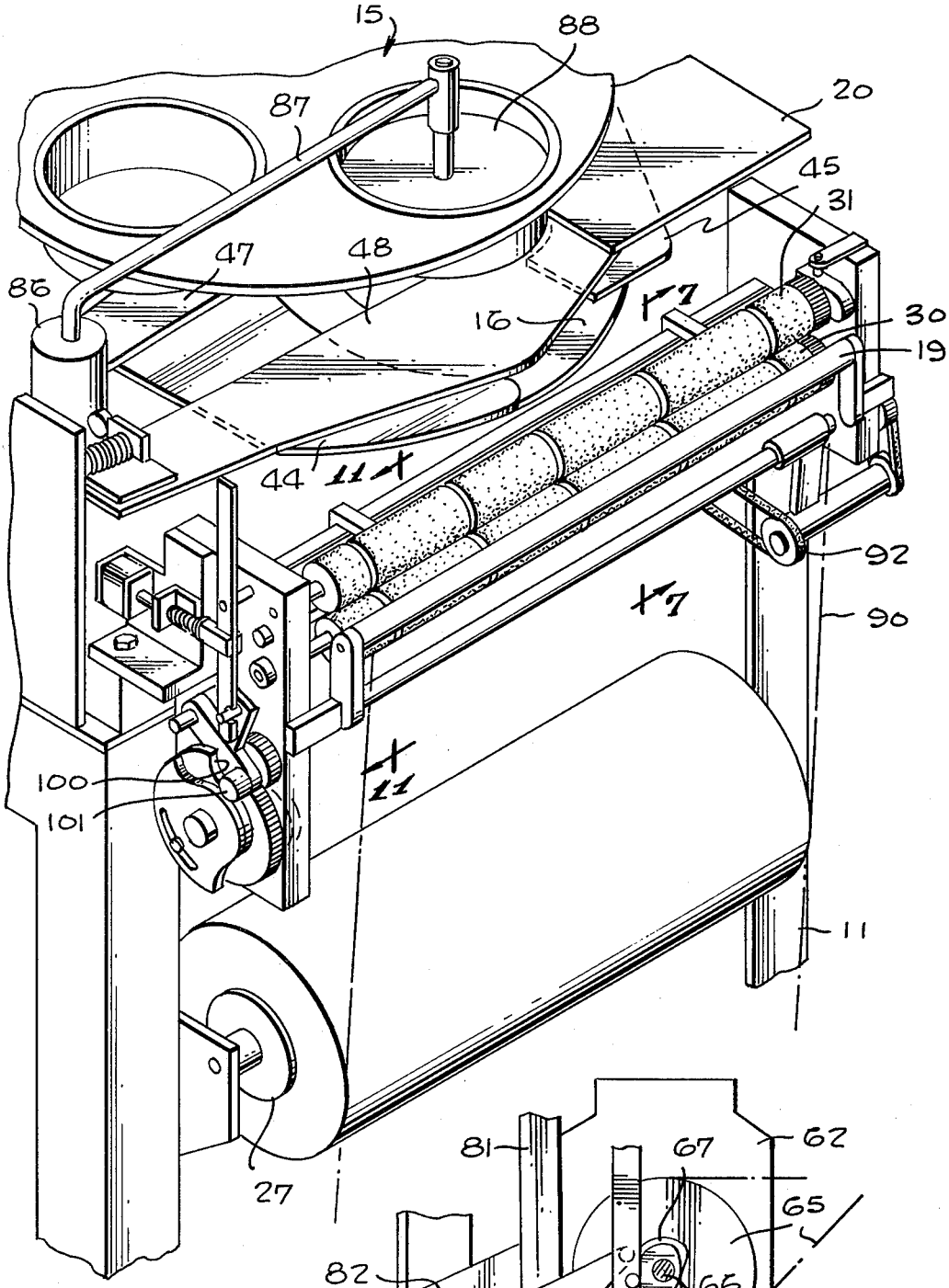
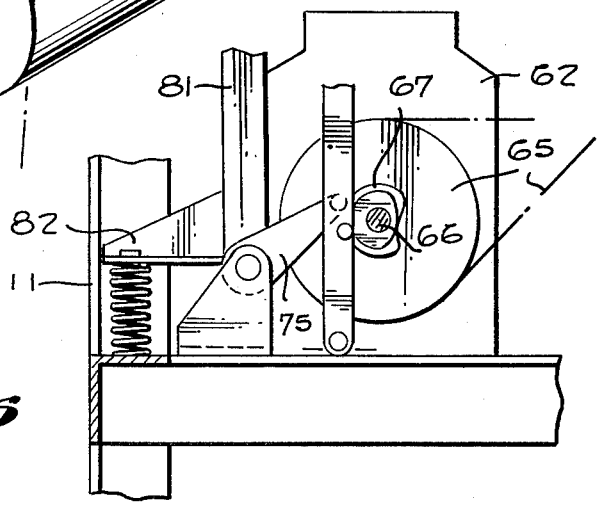
Fig. 5

FOOD PRODUCT PACKAGING APPARATUS

BACKGROUND OF THE INVENTION

1. Field of the Invention

This invention relates to food processing equipment and more particularly to a novel wrapping apparatus for placing paper about a food product which includes a mechanical program means for sequentially operating a variety of mechanical and electrical components.

2. Description of the Prior Art

In the past, food products such as tortillas, for example, have been packaged by hand. The usual steps involved comprise stacking the tortillas in quantities of 12 and then hand wrapping each stack in a sheet of paper so that the tortillas may be further processed and shelf-life may be extended.

Obviously, hand packaging of such a food product is time consuming and expensive. Production yield of the food product is limited and manual or hand handling of the food product packaging leads to errors and product waste. Some attempts have been made to mechanise the packaging procedure which, for example, count the number of tortillas and arrange a predetermined number in a stack while other devices partially wrap paper around a stack of tortillas followed by hand operation for sealing and transporting the packaged product for further processing. However, these prior attempts do not completely avoid manual handling or processing and no apparent attempt has been made to provide a machine for completely accepting a stack of precounted food products such as a stack of tortillas and completely wrapping including sealing the package without manual steps or manual handling of the product between operations.

Therefore, a long-standing need exists to provide a food processing apparatus or packaging equipment that will completely wrap and seal a package of food products without manual operation. Such equipment should provide for automatic operation and the various functions of the machine should have programmed sequences so that manual control of the machine is not necessary.

SUMMARY OF THE INVENTION

Accordingly, the difficulties and problems encountered with conventional food processing equipment for packaging a food product are obviated by the present invention which provides a table frame for supporting a rotating turntable having a plurality of pockets for receiving individual stacks of the food product. Immediately below the turntable is a stationary plate over which the food product is supported as the turntable rotates. Located immediately beneath the stationary plate is a wrapping station adjacent the edge of the stationary plate so that the food product will drop into the station and carry with it a sheet of wrapping paper. Cutting means are provided for severing the sheet of paper and movable wrapping plates are provided for folding the cut paper over the top of the food product and means are provided for transporting the wrapped product to a heater whereby sealing is accomplished on the packaged food product. The turntable operation as well as the paper cutting operation and paper folding operation are under the control of a program means comprising a program disc having a plurality of cam and cam followers associated therewith for imparting sequential operation through a variety of pulleys and linkages to achieve the aforementioned operations.

Therefore, it is among the primary objects of the present invention to provide a novel food processing apparatus capable of wrapping a food product in wrapping paper and for sealing the paper so that a unitary package is produced.

Another object of the present invention is to provide a novel food processing equipment having programming means for providing a sequential series of equipment operations for feeding a food product into the machine and wrapping the product with paper followed by folding the paper and sealing the same.

Still a further object of the present invention is to provide a novel food processing machine for wrapping a food product and sealing the same which is economical to manufacture, relatively easy to maintain and which will provide for automatic operation without human intervention.

A further object of the present invention is to provide food handling equipment for placing a sheet of paper about the food product and folding the paper in such a manner as to completely cover the food product followed by sealing the paper so as to provide a packaged and sealed unitary product.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings.

BRIEF DESCRIPTION OF THE DRAWINGS

FIG. 6 is a perspective view of the food packaging machine of the present invention incorporating a novel paper feed and cutting mechanism.

DESCRIPTION OF THE PREFERRED EMBODIMENT

Figure 1:
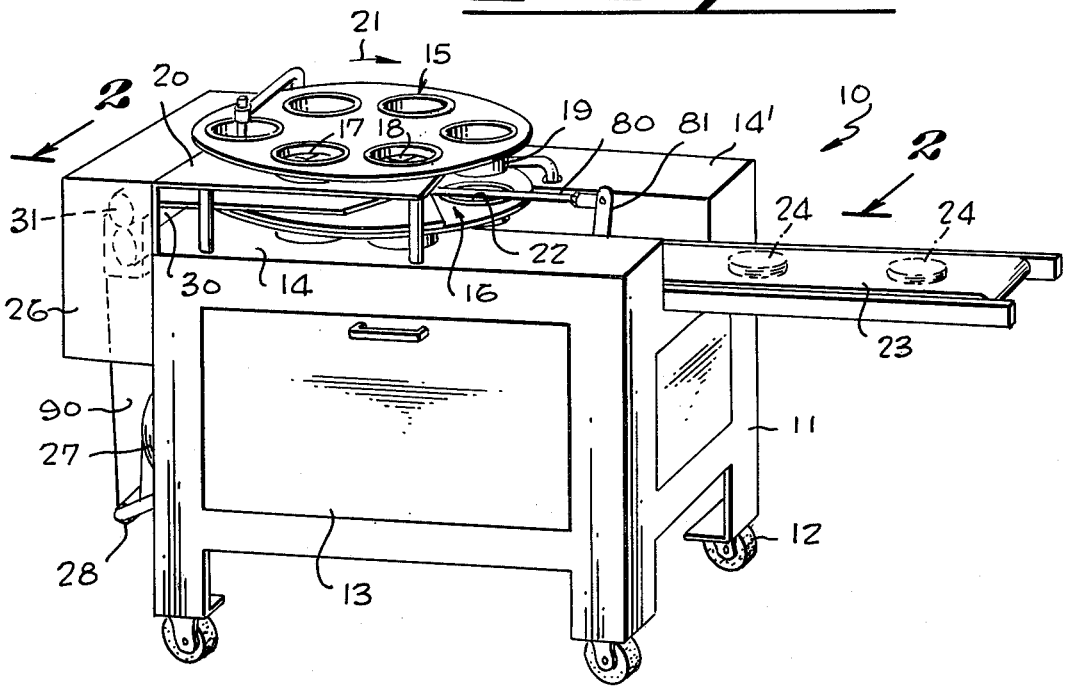
FIG. 1 is a perspective view of the novel food packaging apparatus of the present invention.

Referring to FIG. 1, the novel food packaging apparatus of the present invention is indicated in the general direction of arrow 10 which includes a cabinet frame 11 movable about a work floor on a plurality of wheels or rollers such as is indicated by numeral 12. The machine or cabinet frame 11 includes downwardly depending wheeled legs and a door 13 which when opened will expose the internal components and parts of the equipment. A divided working surface 14 is included on the top of the frame 11 which supports a revolving turntable mechanism having an upper turntable 15 and a lower turntable 16. The upper table 15 includes a plurality of open ended pockets for receiving a stack of food product such as a stack of twelve tortillas. The tortillas are initially loaded into pockets 17 and 18 and are prevented from falling through by means of a stationary plate 20 which supports the food product as the turntable rotates. The turntable turns in the direction of arrow 21 which is in a clockwise direction.

Figure 3:
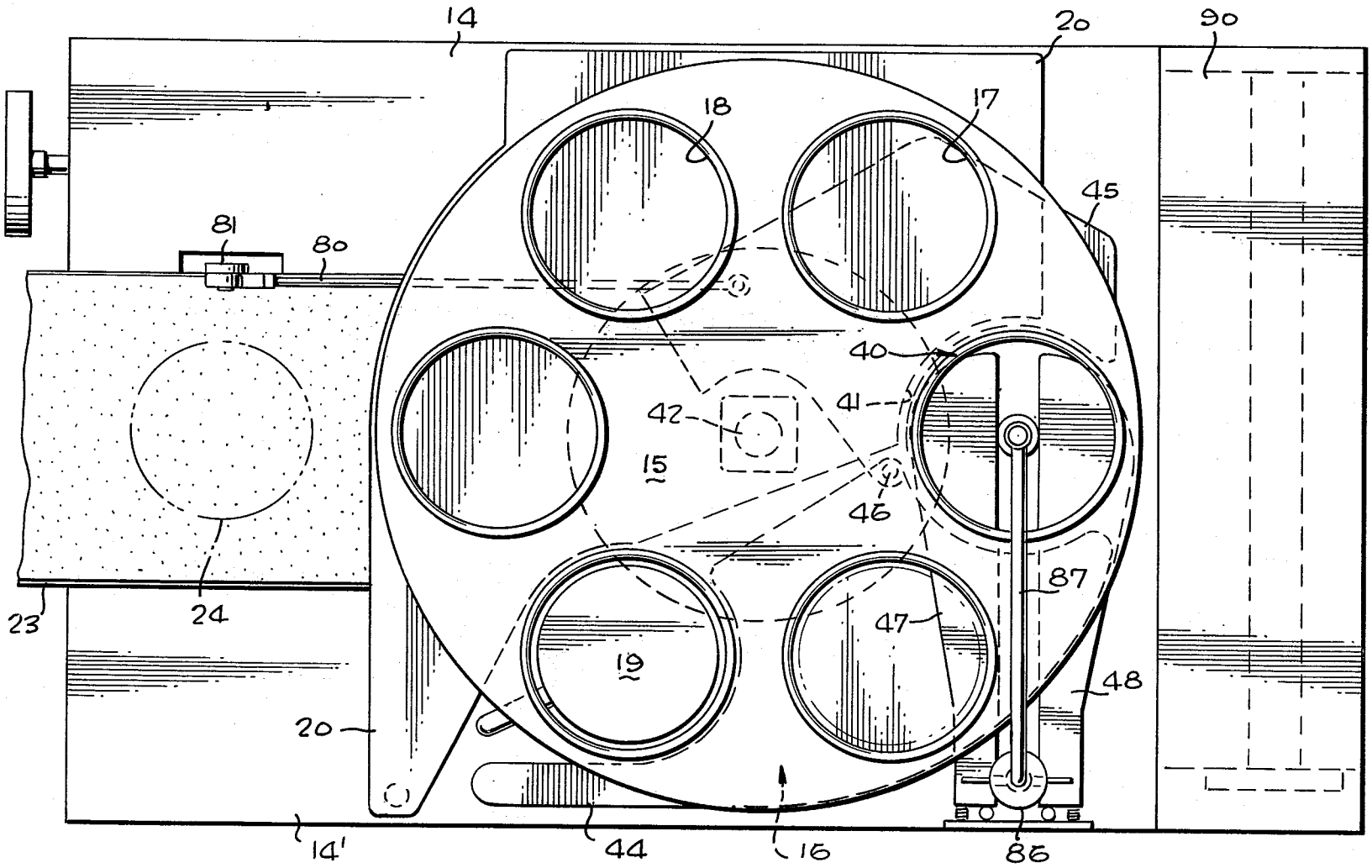
FIG. 3 is a top plan view of the food packaging apparatus of the present invention as taken in the direction of arrows 3—3 of FIG. 2.

At a packaging station 40, the stationary plate 20 is formed with a semi-circular cut-out portion, indicated by numeral 41 in FIG. 3, over which the stack of tortillas passes so as to drop via gravitational force into a pocket 22 carried on the lower turntable 16. The stack is now supported within pocket 22 on table top surface 14.

Lower turntable 16 includes a plurality of open ended pockets, such as pocket 22, for receiving the food product and initially wrapping the product in a paper sheet and for moving the packaged product across a working surface identified as 14' so that the packaged product, as indicated in broken lines by numeral 24, will engage with a heat sealing device 19 and drop onto a conveyer 23. The conveyer 23 is positioned between the table working surfaces 14 and 14' and it extends only partially under turntable 16.

One end of the cabinet or frame 11 supports a paper sheet supply and feeding mechanism which is enclosed under a housing 26. A supply of rolled wrapping paper is identified by numeral 27 and is trained about a feed roller 28 and upwardly directed to a stretching and slaved rollers 30 and 31, where the wrapping paper is directed to a cutting mechanism as will be described in further detail with reference to FIG. 7.

Figure 2:
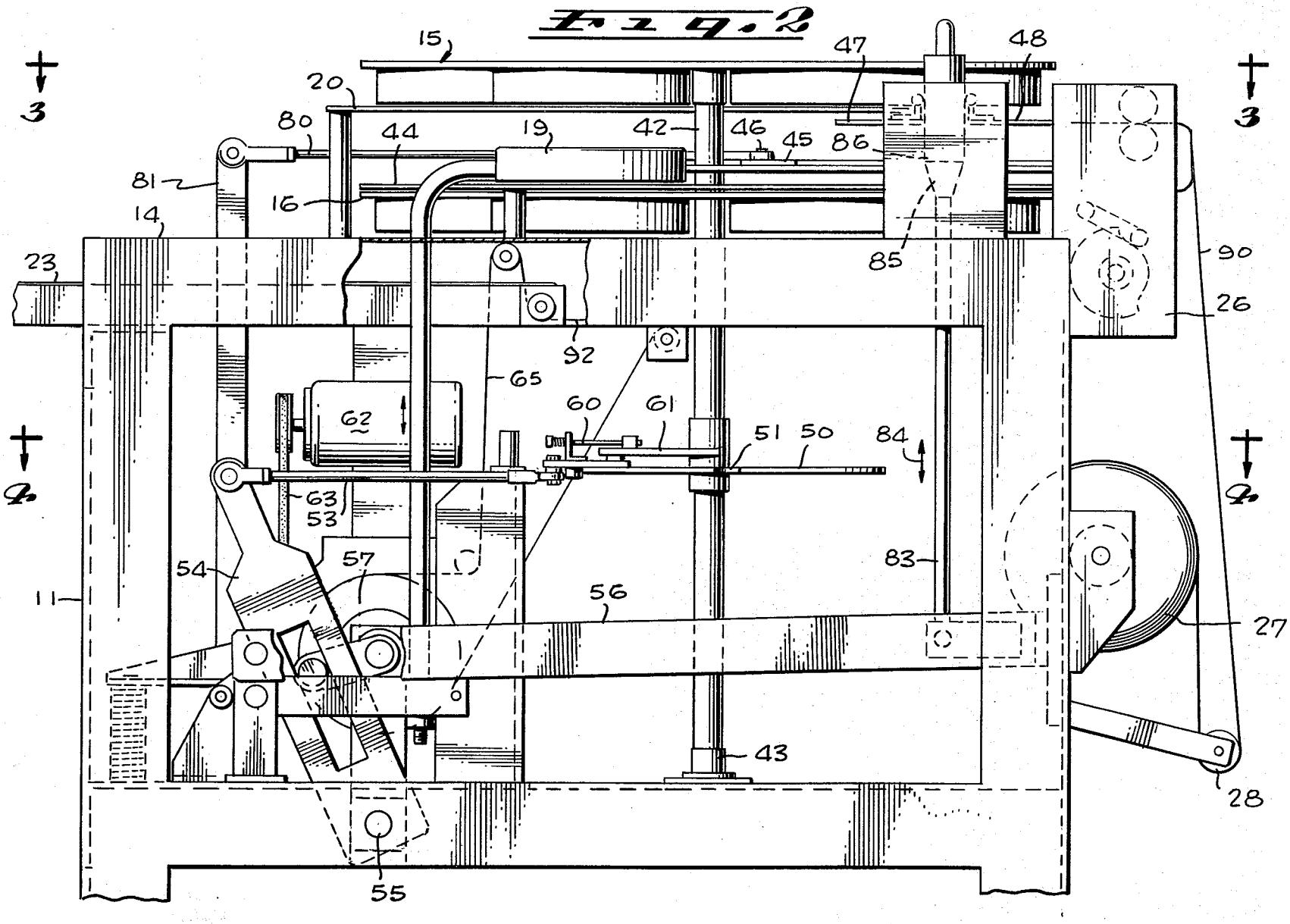
FIG. 2 is a longitudinal cross-sectional view of the apparatus as taken in the direction of arrows 2—2 of FIG. 1 showing the programming means for sequencing a plurality of machine operation.

Referring now in detail to FIG. 2, it can be seen that the stack of tortillas within the respective pockets of turntable 15 are supported on the top plate 20. However, when the tortillas have been moved across the surface of top plate 20 to cut-out portion 41 at the packaging station 40, the tortillas will drop in registry with a pocket carried on the lower turntable 16. The stack is then supported on a pair of gates 47 and 48. When the gates open, the stack drops into the pocket below. The surface 14 now supports the stack of food product as the lower turntable 16 revolves about central shaft 42. As shown in FIG. 2, turntable 15 is fixedly secured to one end of the shaft 42 while the opposite end of the shaft is rotatably carried in a fixture 43 secured to the frame 11. Turntable 16 is secured to the shaft 42 immediately above the table surface 14 but beneath a stationary fold plate 44. As shown more clearly in FIG. 3, the movable fold plate 45 is pivotally mounted on a pivot stud 46.

At the wrapping station 40, the stack of tortillas or other food product drops through the gate into the pocket associated with lower turntable 16 and during the transition, falls against a stretched and cut portion of the wrapping paper so that the paper covers the bottom and sides of the stack when the stack comes to rest on table 14. At this time, the movable folding plate 45 advances across the top of the stack to fold the paper sheet across the top of the stack. Once the paper has been so folded and the turntable 16 continues to revolve, the wrapped stack passes beneath the stationary fold plate 44 so that the stack is completely wrapped and enclosed by the paper. The wrapped stack is now introduced to the heater 19 for sealing the overlapping folds of the paper at the top of the stack.

Figures 4, 5:
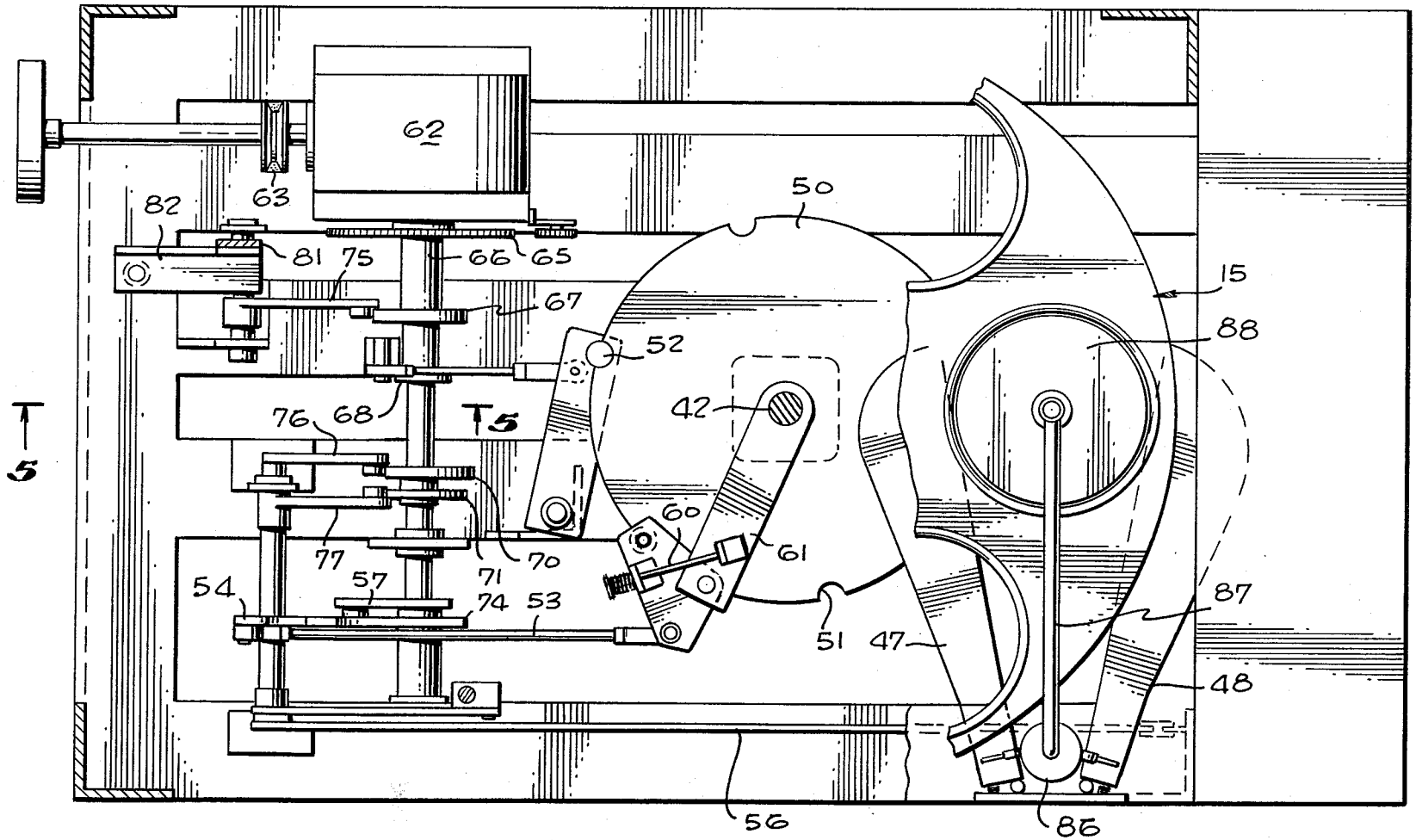
FIG. 4 is a transverse cross-sectional view of the food packaging apparatus as taken in the direction of arrows 4—4 of FIG. 2.
FIG. 5 is a fragmentary sectional view as taken in the direction of arrows 5—5 of FIG. 4.
Figure 8:
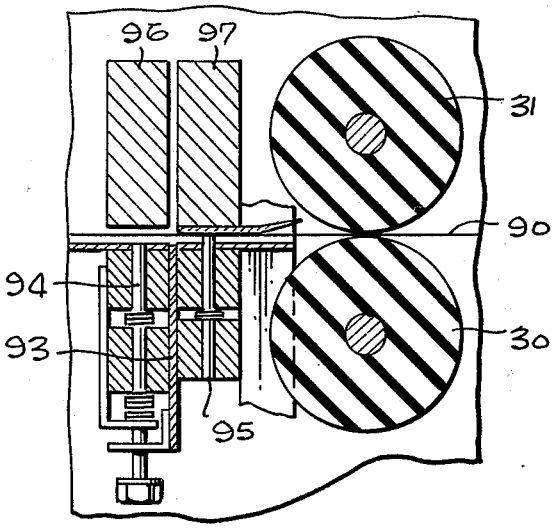
FIGS. 8–10 inclusive illustrate a paper cutting sequence incorporating the cutting mechanism shown in FIG. 7.
Figure 9:
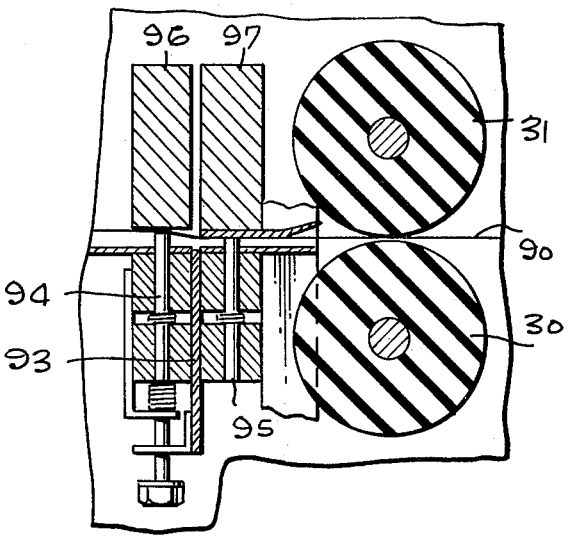

Continuing further with reference to FIG. 2, for selectively and sequentially operating and folding turntables as well as paper mechanism are substantially illustrated. The primary timing device of the present invention includes a disc 50 secured to the shaft 42. The peripheral edge of the disc 50 includes a plurality of spaced-apart notches, such as notch 51, and the peripheral edge is engaged by a cam such as cam follower 52 as shown in FIG. 4. Through a suitable mechanical linkage which includes a rod 53 connected to one end of an arm 54 which controls turret or disc 50. It is reciprocated by a cam follower 57 on a circularly moving arm. A cam 71 and a cam follower 77, as shown in FIG. 4, operates and controls a plunger arm 56. The plunger arm raises and lowers plunger shaft 83 and attached tapered cam 86 which opens and closes gates 47 and 48. The link 53, as shown more clearly in FIG. 4, includes a cam which rides on the periphery of disc 50 and engages with the edge notches at particular and predetermined times in the machine operation. Also, a damper is provided as indicated by numeral 60 which is carried on an arm 61 fixed to the shaft 42.

The main drive for actuating the mechanism is derived from an electrical motor 62 having a belt drive 63. By means of a drive train, which is indicated by numeral 65, a conveyer belt indicated by numeral 23 is operated in a continuous and endless matter about end of rollers in a conventional way. A drive shaft 66 extends substantially across the train 11 and includes a plurality of timing cams indicated by numerals 67, 68, 70, 71, 72 and 73. Associated with each of the drive cams, are a plurality of cam followers that are represented by numerals 75, 76, 77.

It can be seen that the fold plate 45 is pivoted about connection 46 by means of a link 80 which is pivotally carried at its opposite end to a lever arm 81. Lever arm 81 in turn is simply carried on a mount 82 which is fixed to the frame and is rotated in mount 82 by means of cam follower 75 following the eccentric cam 67. In a similar manner, in the gate mechanism comprising pivoting gates 47 and 48 are operated by the cam follower 57 and its associated linkage. For operation of the gates, a rod 83 is moved in a rectilinear manner up and down in accordance with the double arrow 84. The extreme end of rod 83 is provided with a tapered cam 85 leading to a straight cylinder cam 86. As particularly noted in FIG. 4, the cylindrical cam 86 is disposed so that its periphery engages between the opposing edges of the gates 47 and 48 which causes the gate to pivot outwardly with respect to each other so that their opposite ends open for passage of a tortilla stack therethrough. However, when the rod 83 is raised, the tapered cam 85 interposes between the gates 47 and 48 so that the gates will move toward each other to restrict the movement of the next stack of tortillas through the wrapping station 40 until the previous stack has been wrapped by the paper and ready to be advanced to the next sealing station.

Also, it is to be noted that the extreme end of rod 83 beyond the cams 85 and 86 includes a cantilevered arm 87 that extends over the pocket at the receiving station or wrapping station 40 associated with turntable 15. The end of arm 87 includes a plate 88 that moves up and down against the stack of food product in accordance with the up and down movement of rod 83. As noted in FIG. 3, the gates 47 and 48 are closed to support the stack over the wrapping paper sheet which is indicated by numeral 90.

Referring now to FIG. 5, a typical cam operation for timing purposes is illustrated wherein the cam 67 carried on rotating shaft 66 operates the cam follower 75 so as to move the link 81 back and forth. The opposite end of link 81 is connected to rod 80 for moving the movable fold plate 45 at a proper time and sequence. FIG. 5 further illustrates the conveyor drive which includes a gear and belt system 65.

Referring now to FIG. 6, it can be seen that the paper sheets 90 carried on roller 27 is feed from the roller which is rotatably carried on the frame 11 upwardly across stretch roller 91. The paper next is trained over pressure roller 31 and then across the table top 14 above lower turntable 16. The paper 90 extends through the paper feed and pressure roller 31 which are driven via a drive chain as indicated in general by the numeral 92. As seen more clearly in FIGS. 7–12, a cutting mechanism is provided for severing the paper preparatory to wrapping the stack 24.

Figure 7:
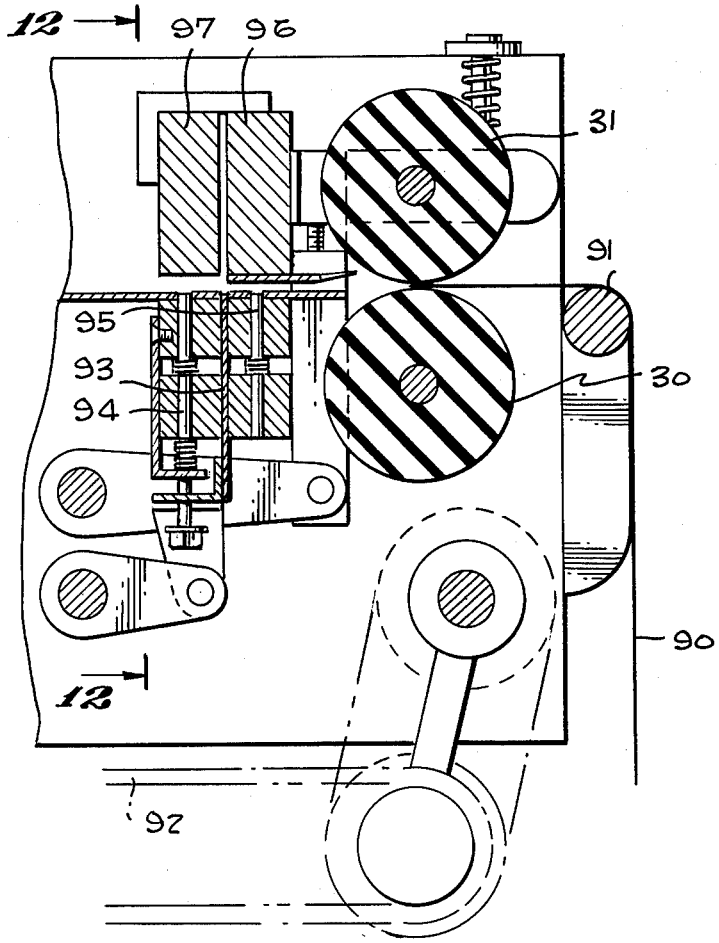
FIG. 7 is a transverse cross-sectional view of the paper cutting mechanism shown in FIG. 6 as taken in the direction of arrow 7—7 thereof.
Figure 10:
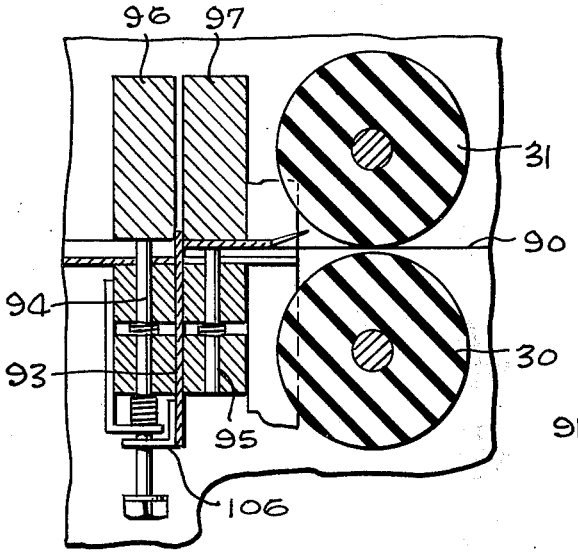
Figure 11:
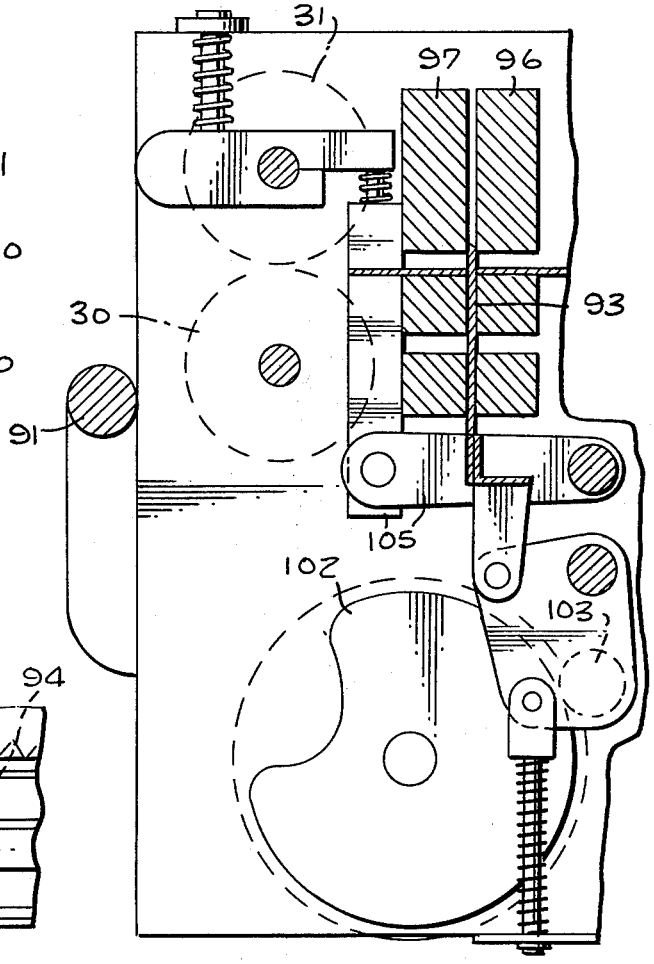
FIG. 11 is a fragmentary sectional view taken in the direction of arrows 11—11 of FIG. 6.
Figure 12:
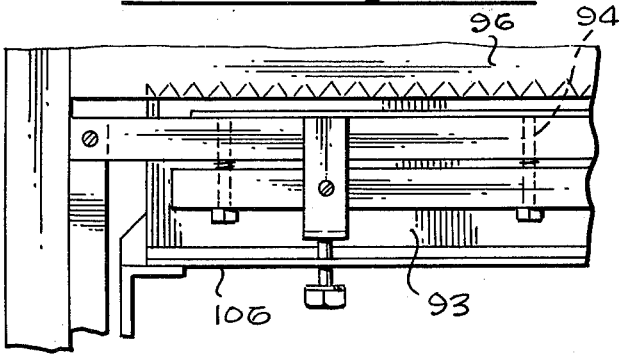
FIG. 12 is a sectional view of the paper cutting means.

In FIG. 7, it is noted that the pressure feed rollers 30 and 31 are driven in counter rotation so that the paper 90 is introduced to a cutting station wherein the cutter is broadly identified by the numeral 93. The up and down movement of the cutter is under the control of a cam operated mechanism and the edge of the cutter includes a plurality of serrations such as noted in FIG. 12 by numeral 94. As shown in the FIGURE sequence, the paper is introduced to the cutting station with the cutter withdrawn as shown in FIG. 7. Next, a pair of holder constituting plates are identified by numerals 94 and 95 respectively which press the paper against holding blocks 96 and 97 so that the cutter may be raised in between as shown in FIG. 10 to sever the paper. As shown in FIG. 11, the cam and cam follower device for operating the cutter is illustrated. This FIGURE is in conformity with the respective use shown in FIG. 6 wherein the cam is illustrated by numeral 100 and the cam follower by numeral 101. In FIG. 11, the backside of cam 100 is indicated by numeral 102 and its cam follower is indicated by numeral 103, however, it is to be understood that the cams are on a common shaft so that the paper feed drive and the cutting operation are properly sequenced. As the cam follower 103 pivots on its mount, a plurality of links as broadly indicated by numeral 105 move the drive roller 31 up and down against the paper. As shown more clearly in FIGS. 6, 10 and 12, the cutter is operated by the cam 100 via its follower 101. The cutter 93 is carried on a actuating mechanism indicated by numeral 106 which is spring biased in a downward position.

Therefore, it can be seen that the device of the present invention provides a means for moving a food product such as a stack of tortillas from a loading position to a wrapping station where a stack is introduced to a cut length of paper where it is partially wrapped by gravity feed and then passed to a sealing apparatus where the heat of the sealer effects complete closure of the food product. The food product once wrapped will pass to the conveyer 23 for transport to another handling station. Timing means are provided for selectively operating the upper turntable for introducing the food product to the wrapping station, for temporarily holding the food product by the gate mechanism followed by opening the gate so that the cut paper will receive and partially wrap the product, folding the edge marginal regions of the paper over the product by actuating movable hold plate 45 and then using the stationary hold plate to hold the paper in position while the package is introduced to the sealing station.

The sequencing of the turntables with respect to each other as well as the operation of the cutting mechanism for the paper and the feed mechanism for the paper is important and a variety of cam and cam followers are all sequenced from a primary rotating disc 50. Furthermore, the paper feed mechanism as well as the cutting mechanism are sequenced and timed with respect to each other as well as with respect to the presence of the food product within the wrapping station.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A food product wrapping machine comprising:

a base having a working surface;

a first and second means rotatably carried on said base in vertical fixed spaced apart relationship wherein each of said means are provided with a plurality of pockets in vertical registry for receiving said food product via gravity transference therebetween;

gating means operably disposed between said first and second means for supporting said food product during transition therebetween;

paper supply means operably carried on said base for supplying a sheet of paper between said first and second means and said gating means engagable with said food product during said gravity transference;

folding means interposed between said gating means and said second means for folding the edge marginal regions of said paper sheet about said food product;

control means interconnecting said above-mentioned means for timing and sequencing the operation thereof with respect to each other;

said paper supply means includes a cutting means having a reciprocably moving serrated cutting edge; and clamping means operable to retain said paper sheet taut on opposite sides of said cutting edge.

2. The invention as defined in claim 1 wherein said first and second means comprise a pair of turntables coaxially disposed with respect to each other and secured to a rotating shaft vertically mounted on said base.

3. The invention as defined in claim 2 wherein said gating means includes a pair of gate elements pivoted at one end so as to open and close to alternately support and transfer said food product between registered pockets of said turntables.

4. The invention as defined in claim 3 including a tapered cam movably interposed between adjacent pivoted ends of said gate elements for controllably opening and closing said gate elements.

5. The invention as defined in claim 4 wherein said control means includes a program disc having a cam peripherial edge rotatably carried on said shaft; and a plurality of cams and cam followers operably interconnecting said program disc with said gating means, said paper supply means and said folding means for timing their respective sequences of operations.

6. The invention as defined in claim 5 including a heater carried on said base engagable with said wrapped food product for sealing said paper sheet edge marginal regions.

7. The invention as defined in claim 6 including a conveyer belt movably disposed beneath said turntables for receiving said wrapped food product after sealing by said heater.

* * * * *